US005789022A

United States Patent [19]

Kustermann et al.

[11] Patent Number: 5,789,022

[45] Date of Patent: Aug. 4, 1998

[54] METHOD AND DEVICE FOR INDIRECT COATING OF AT LEAST ONE SIDE OF A MATERIAL WEB UTILIZING A FREE JET

[75] Inventors: Martin Kustermann; Bernhard Kohl; Michael Trefz, all of Hiedenheim; Friedhelm Ruhl; Ingo Gottwald, both of Steinheim, all of Germany

[73] Assignee: Voith Sulzer Papiermaschinen GmbH, Heidenheim, Germany

[21] Appl. No.: 620,500

[22] Filed: Mar. 22, 1996

Related U.S. Application Data

[63] Continuation-in-part of Ser. No. 380,089, Jan. 30, 1995, abandoned.

[30] Foreign Application Priority Data

Jan. 31, 1994 [DE] Germany ..... 44 02 627.7

[51] Int. Cl.[6] ..... B05D 1/28; B05C 1/08

[52] U.S. Cl. ..... 427/211; 427/348; 427/356; 427/428; 118/63; 118/249; 118/261

[58] Field of Search ..... 118/248, 249, 118/261, 63; 427/356, 428, 211, 348

[56] References Cited

U.S. PATENT DOCUMENTS

| | | | |
|---|---|---|---|
| 3,257,226 | 6/1966 | Thwaites | 117/64 |
| 3,418,970 | 12/1968 | Phelps et al. | 118/410 |
| 3,521,602 | 7/1970 | Coghill | 118/410 |
| 3,899,615 | 8/1975 | Wallstén | 427/211 |
| 4,231,318 | 11/1980 | Zink | 118/122 |
| 4,246,301 | 1/1981 | Alheid et al. | 427/348 |
| 4,588,470 | 5/1986 | Abegglen | 156/578 |
| 4,848,268 | 7/1989 | Sollinger et al. | 118/227 |
| 4,871,593 | 10/1989 | McIntyre | 427/428 |
| 4,985,284 | 1/1991 | Shibata et al. | 427/428 |
| 5,224,995 | 7/1993 | Shimbamoto | 118/249 |
| 5,318,804 | 6/1994 | Yoshida | 427/356 |

FOREIGN PATENT DOCUMENTS

| | | |
|---|---|---|
| 34 17 487 | 11/1985 | Germany . |
| 35 26 257 | 1/1987 | Germany . |
| 37 16 520 | 12/1988 | Germany . |
| 59-22684 | 2/1984 | Japan . |

OTHER PUBLICATIONS

Patents Abstracts of Japan, "Coating Device", Aug. 29, 1986, vol. 10, No. 252.

Derwent World Patent Index Abstract of DE 37 16 520.

*Primary Examiner*—Katherine A. Bareford

*Attorney, Agent, or Firm*—Marshall, O'Toole, Gerstein, Murray & Borun

[57] ABSTRACT

A method for at least one-sided coating of a material web with an application medium is performed by a two-element applicator device having at least one applicator roll and a counter element defining a gap through which the material web is conveyed. The method includes the steps of pre-metering the application medium onto the applicator roll and transferring the application medium onto the material web in the gap. Pre-metering of the application medium to the applicator device is performed by at least one free jet.

11 Claims, 2 Drawing Sheets

METHOD AND DEVICE FOR INDIRECT COATING OF AT LEAST ONE SIDE OF A MATERIAL WEB UTILIZING A FREE JET

CROSS-REFERENCE TO RELATED APPLICATIONS

This is a continuation-in-part of pending U.S. application Ser. No. 08/380,089, filed Jan. 30, 1995, now abandoned.

BACKGROUND OF THE INVENTION

1. Field of the Invention

The invention relates to methods and devices for coating running webs of material, and particularly to methods and devices for coating at least one side of a material web by pre-metering an application medium onto an applicator roll and transferring the medium onto the web in a gap formed by the applicator roll and a counter element.

2. Description of Related Technology

In the art of paper finishing, various methods and devices are known for coating a paper web with an application medium. The coating of the web may be performed by applying the medium directly onto the fiber web which loops around a portion of a periphery of a body with rotational symmetry. Another coating method includes pre-metering an application medium onto a surface of a body with rotational symmetry. In both cases, the application process includes two successive steps: 1) the coating is applied in excess utilizing an application nozzle; and 2) excess coating composition is removed utilizing an equalizing system, typically in the form of a doctor element, or successive doctor and blade devices. The composition transfer or metering may be performed, for example, in a film press. In conventional film presses, the application medium is applied onto the surface of the applicator roll, in which case the metering is usually achieved by successive doctor devices. The pre-metering devices are disposed on the framework of the applicator roll and can be pressed onto the surface of the applicator roll with the aid of cylinders or similar devices. The pre-metering device may include a nozzle applicator system in which a sizing or coating composition flows through a special distributor (flow spreader) system into a pressure chamber of the applicator nozzle. Such a device may also include a doctor bar device. The application medium arrives into the application chamber through a slotted nozzle of the pressure chamber. The amount of sizing or coating composition is controlled with the aid of a doctor bar or a blade to which pressure can be applied.

Such devices may be complicated in structure, particularly with respect to the application and metering system and may be problematic since they utilize a metering element that can get worn down. Therefore, keeping the amount of film constant with respect to a function of time can present problems and cannot be directly influenced. A transverse profile of an applied medium on an applicator roll can be kept constant only by tedious profile adjustment work. Otherwise coating composition application along a width of the machine does not necessarily occur uniformly. Furthermore, at high solid contents or in the case of extremely absorbent papers, there is a danger of the formation of profile ridges, which may cause a limitation of the minimum amount of coating composition that may be applied. The use of a metering element that is readily worn leads to short life spans of such a metering element and thus to undesirable shutdown time of the machine necessitated for replacing the metering element. Furthermore, control of the amount of coating composition applied to a roll is not possible without replacement of the metering element or without tedious adjustment work.

SUMMARY OF THE INVENTION

It is an object of the invention to overcome one or more of the problems described above. It is also an object of the invention to keep constant the amount of film to be transferred onto a fiber web as a function of time and with respect to the width of the machine, that is, transversely to the direction of movement of the fiber web. Moreover, it is an object of the invention that the amount of coating composition film to be applied should be controllable for certain web widths. Furthermore, an object of the invention is to minimize the wear of a metering element and thus to achieve a longer time period between required changes of the metering element. An object of the invention is also to provide for low operating costs and suitability for use for both coating and starch application.

According to the invention, the metering element is preferably strongly built, easy to handle, show little tendency to be damaged, suitable for use at high application velocities, easy to operate and should have only a very small number of wearing parts.

The invention concerns a method for at least one-sided coating of a material web with an application medium in a two-element applicator device having at least one applicator roll and a counter element defining a gap through which the material web is conveyed. The inventive method includes the steps of pre-metering the application medium onto the applicator roll and transferring the application medium onto the material web in the gap. Pre-metering of the application medium to the applicator device is performed by at least one free jet.

Other objects and advantages of the invention will be apparent to those skilled in the art from the following detailed description taken in conjunction with the drawings and the appended claims.

DETAILED DESCRIPTION OF THE INVENTION

Figure 1:
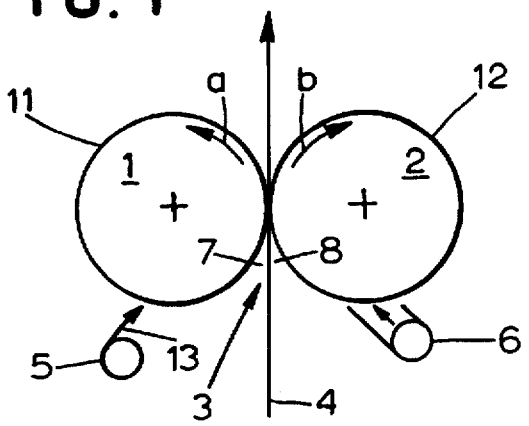
FIG. 1 is a schematic sectional view of a device according to the invention.

According to the invention, pre-metering of a coating, such as a color coating, or other application medium is performed utilizing a two-element applicator device that introduces the medium onto the surface of an applicator roll, at least indirectly, that is, both directly as well as indirectly, by application of the application medium with the aid of at least one free jet. As defined herein, a "free jet" is a stream of fluid which is forced from a nozzle or spout and freely impinges upon a surface to be coated (e.g., an applicator or transfer roll). In other words, there is nothing to keep the "free jet" from motion from a nozzle or spout all the way to a surface being coated as it is not otherwise constrained, i.e., the jet is open and unimpeded from the nozzle or spout to a point of impingement on the surface of the applicator or transfer roll being coated. This is in contrast to prior art "extrusion" coating apparatus which do not produce a "free jet" but rather a wedge-shaped convergent flow between the coating of device and the surface to be coated is generated for increasing generation of pressure. In such extrusion coating apparatus, the edge of the coating device may be of a specified length and oriented in a position with respect to a substrate being coated that pressure is generated between the edge of the coating device and the substrate being coated. In contrast, a "free jet" according to the invention is a pressurized jet of a coating medium that is emitted from a nozzle or other spout disposed at a distance from a surface being coated so that the jet of material freely impinges onto the applicator roll surface and pressure is not generated between the nozzle or spout and the surface being coated.

The use of a free jet provides the advantage of direct control of the applied amount and thus the thickness of the applied film on the surface of the applicator or transfer roll. Also, the applied amount and film thickness may be altered by changing certain parameters of the jet, for example, discharge cross-section, discharge velocity and application angle of the free jet, in relation to the rate of rotation of the applicator roll.

The free jet can be directed either directly onto the surface of an applicator roll or onto the surface of a transfer roll, which, again, transfers the application medium at least indirectly, that is, directly or through another transfer roll, onto the surface of the applicator roll. The latter variation (indirect application) also provides the advantage of further metering action, especially the extension of the applied film based on the velocity difference of the surfaces of the applicator roll and the transfer roll obtained by suitable adjustment of the ratio of the diameters of the applicator roll and transfer roll.

According to the invention, a device for performing at least one-sided coating of a material web with an application medium includes first and second applicator elements driven in opposite directions and defining a gap for the passage of a material web therebetween. Also, an applicator unit cooperates with at least one of the applicator elements. The applicator unit includes an apparatus for producing a free jet. The free jet thus indirectly pre-meters an application medium onto the surface of the applicator element cooperating with the free jet. The apparatus for producing a free jet can be assigned directly to the applicator element (the free jet is directed directly onto the surface of the applicator element) or can be assigned to this indirectly by connecting at least one transfer element before it.

Preferably, the two-element applicator device is designed in the form of a two-roll applicator arrangement, that is, two applicator rolls with parallel axes are driven in opposite directions and form a press gap through which the material web is conveyed. The application of the application medium onto the web is accomplished by passage of the web through the press gap during which the application amount that was pre-metered onto the surface of the applicator roll is transferred onto the web. Such a device is suitable for one-sided coating, as well as for two-sided coating of fiber webs with application composition. The same or different application media can be applied to opposite sides of the web. According to the invention, the following is possible:

1) The application of a medium is performed directly, i.e., directly onto the surface of an applicator roll; and 2) the application is done here indirectly, i.e., onto the surface of a transfer roll assigned to the applicator roll.

Possibility (2) above provides the advantage of additional metering action with suitable design of the ratio of the diameters of the applicator roll and the transfer roll, as a rule, in the form of stretching or extending the film by the transfer roll. This is especially advantageous when a particularly thin applied film is desired on the surface of the fiber web.

There are two preferred variations for the design of the device for producing a free jet:

1) A free-jet nozzle device; and 2) a closed head box with a pressure-loaded central container and a variably adjustable outlet opening.

The free-jet nozzle device can be designed as disclosed in U.S. Pat. Nos. 3,418,970, 3,521,602 and 4,231,318. The free-jet nozzle device is, as a rule, a pure applicator device with its own supporting body, which includes, for example, a flow spreader and a slotted nozzle extending over the width of the machine (i.e., the length of an applicator roll). The application of a medium is performed without the nozzle coming in contact with the surface of the applicator element. The free-jet nozzle device can be displaced in a radial direction with respect to the surface of the applicator roll and can be rotated around a certain axis in such a way that the application angle can be varied and adjusted with respect to the surface of the applicator roll. Preferably, the nozzle device is disposed with respect to a surface of an applicator roll (as shown in U.S. Pat. No. 3,418,970) in such a way that a converging gap is formed in the direction of application, that is, in the direction of the movement of the roll, between the surface of the applicator or transfer roll and the free-jet nozzle device.

A free-jet nozzle device according to the invention is preferably disposed at least about 4 mm from the surface of the applicator or transfer roll to be coated, thus providing for the emission of a jet which travels freely over a distance until the jet impinges on a surface of an applicator or transfer roll. This provides for a uniform coating of the surface of the roll. Also, any gas entrapped in the coating medium can escape upon impingement with the surface of the applicator or transfer roll.

Furthermore, according to the invention, a nozzle channel of a nozzle device, i.e., a connecting line or tube between the flow spreader and the nozzle exit can be curved. The curvature of such a channel runs essentially in a direction converging to the applicator roll or transfer roll. Then, in this method, a low-air layer lies against the roll and an air-rich layer is toward the outside thereof.

The metering action of the two systems during application is determined by various factors. These include:

1) The flow or discharge cross-section from the free-jet nozzle or head box container;

2) The discharge velocity of the application medium;

3) The pressure in the flow spreader or container; and

4) The rate of rotation of the applicator roll.

A change in the discharge cross-section and in the rate of rotation of the applicator roll or transfer roll can be realized simply with constructional measures, while the change of the discharge velocity should be considered as a function of the discharge cross-section and of the design of the nozzle or of the container (especially the cross-sectional changes between the flow spreader or container and discharge cross-section).

According to another aspect of the invention, the two-element applicator device can include an applicator roll, which, together with a belt moving therearound, forms an extended press gap for the passage of a material web therethrough. Then, preferably, the application of the free jet is onto the surface of the applicator roll, but application onto the web can also be considered under certain circumstances. Such a device is also suitable for one-sided and two-sided coating of material webs.

Preferably, according to the invention, devices for producing the free jet are disposed in the vicinity of the surface of the applicator roll or transfer roll which lies in the direction of rotation of the rolls, in the region before the press gap inlet. Arrangement in areas that are removed from the inlet of the press gap are also conceivable. In this case, preferably, additional equalization devices, for example, in the form of air brushes, are used on the roll surface to make the applied film uniform.

Application of a medium according to the invention with the aid of a free jet onto the surface of an application element provides the advantage of direct controllability of the pre-metering of the application medium onto the surface of an applicator element and thus of pre-metering of the applied amount to be transferred in the press gap. Furthermore, the system according to the invention provides the advantage that the amount of film to be applied can be kept constant as a function of time and along the width of the roll. The application and metering system is characterized by a low number of wearing parts and thus by longer time periods between the required change of the metering elements. The adjustability of the size of the discharge openings as well as changes in position with respect to the applicator element can be realized easily from the constructional point of view. The method according to the invention is suitable for coating compositions as well as for starch.

Further advantages of the invention of the application are realized in the coating of paper webs with coating colors. Various coating colors employed for coating of paper webs contain air or other gases. According to methods and apparatus of the invention, the coating color is spread uniformly onto the surface of an applicator or transfer roll and any gas entrapped in the coating color escapes upon impingement of the coating color on the roll surface in the form of a free jet. This is particularly surprising and advantageous as the color coating is therefore much more uniform since the coating does not include air bubbles. Furthermore, the inventors found it surprising that with the coating method and apparatus of the invention, coating color applied onto the surface of an applicator roll in the form of a jet remains on the surface, and further, spreads uniformly on the surface.

For application of a medium according to the invention with the aid of an open head box, additional precautions are taken in order to achieve the desired direct influence on metering. Additional damping or other perturbing elements can be included in the discharge area from the open container.

With reference to the drawings, FIG. 1 shows a two-roll applicator device with a free-jet nozzle device assigned to one of the applicator rolls and an SDTA with a doctor assigned to the other applicator roll. An applicator roll 1 and an applicator roll 2, which are arranged so that their axes are parallel to each other and are supported rotatably. The rolls 1 and 2 define a roll gap 3 for the passage of a material or fiber web, especially a paper web 4 therethrough. The two applicator rolls 1 and 2 are driven in directions opposite to each other and indicated by arrows a and b. Essentially, an applicator unit or apparatus 5, 6 for a flowable medium is disposed in the vicinity of the roll periphery of each roll 1, 2 that moves from down upward. The fiber web 4 is guided through the roll gap 3 from down upward. In regions 7, 8, which are formed by the roll gap 3 with the fiber web 4, a film of a flowable medium is applied through the roll surfaces, onto both sides of the fiber web 4. By passing the fiber web 4 upward through the roll gap 3, the application medium, for example, a coating composition, is applied at the desired thickness onto the fiber web 4 corresponding to the distances of the rolling circles of both the rolls 1 and 2.

The applicator apparatus 5 is designed as a free-jet nozzle device. The nozzle channel of the free-jet nozzle device 5 is preferably curved. The apparatus 5 emits a free jet of coating material, i.e., sprays the coating material, which travels freely over a distance until it reaches the surface of the applicator roll 1. The distance between the free-jet nozzle device 5 and the roll 1 is preferably at least about 4 mm. The free jet indicated by an arrow 13 is shown schematically. The applicator apparatus 6 is designed as an STDA with doctor, for example, as disclosed in unpublished DE 42 430 276. The coating composition is applied on each roll surface 11 and 12 of the rolls 1 and 2.

Figure 2:
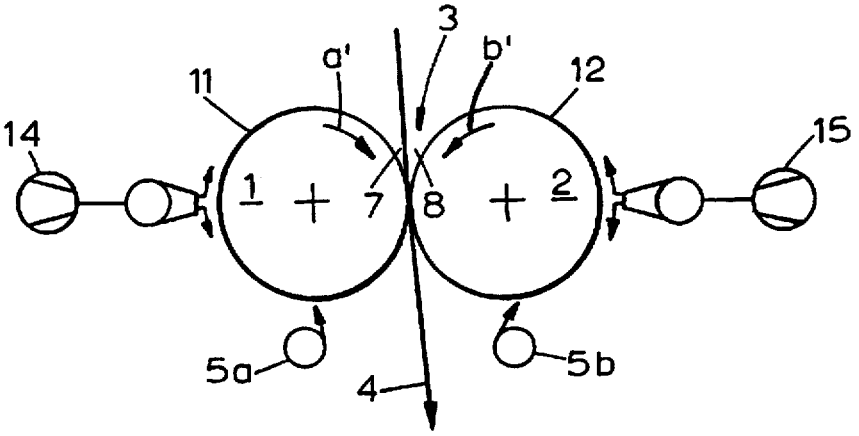
FIG. 2 is a schematic sectional view of a second embodiment of a device according to the invention.

FIG. 2 shows an embodiment of a device according to the invention which is analogous to the device shown in FIG. 1. However, the device of FIG. 2 also includes additional equalizing devices. Therefore, the same reference numbers are used for the same elements in both FIGS. 1 and 2. However, in FIG. 2, the fiber web 4 is guided through the press gap 3 from the top toward the bottom. In the region of the lower area of the part of the roll periphery or of the roll surfaces 11, 12 of each roll 1, 2, which runs from down upward, an applicator unit 5*a* and 5*b*, respectively, is disposed for the application medium, for example, a coating composition. In this case, in regions 7, 8, formed by the roll gap with the fiber web, a film of a flowable medium is applied onto the fiber web 4 through roll surfaces 11 and 12, respectively. In addition, in the vicinity of the roll surfaces 11 and 12, respectively, which are disposed downstream of the applicator devices 5*a* and 5*b* with respect to the direction of rotation of the rolls as indicated by arrows a' and b', additional equalizing devices 14 and 15, respectively, are provided in the form of air brushes. The air jets produced by the air brushes 14 and 15 make the applied coating composition more uniform before it is transferred onto the fiber web 4 in the roll gap 3.

Figure 3:
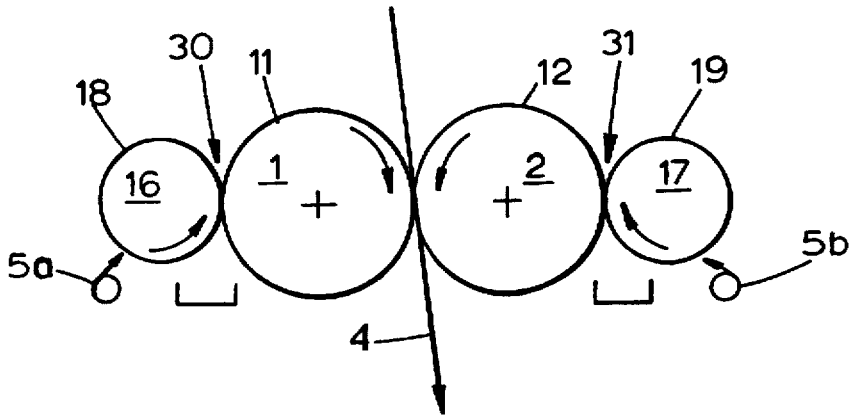
FIG. 3 is a schematic sectional view of a third embodiment of a device according to the invention.

FIG. 3 illustrates a two-roll applicator device according to the invention having additional transfer rolls which rotate in a direction opposite to that of the applicator rolls, and define a gap therewith. The basic structure of the device of FIG. 3 corresponds to the structure of the device shown in FIG. 2 and therefore the same elements have been assigned the same reference numbers. Transfer rolls 16 and 17, with respective applicator devices 5*a* and 5*b*, in the form of at least one free-jet nozzle, are assigned to the applicator rolls 1 and 2, respectively. The applicator rolls 1 and 2 and respective transfer rolls 16 and 17, define gaps 30 and 31, respectively. Each of the transfer rolls 16 and 17 preferably have a smaller diameter than the respective applicator rolls 1 and 2. As a result, there is always a velocity difference between the surfaces 11 and 18 as well as the surfaces 12 and 19, between applicator rolls 1 and 2 and transfer rolls 16 and 17, respectively. This velocity difference contributes to stretching or extending of the coating or other application film and thus to an additional metering effect.

Figure 4:
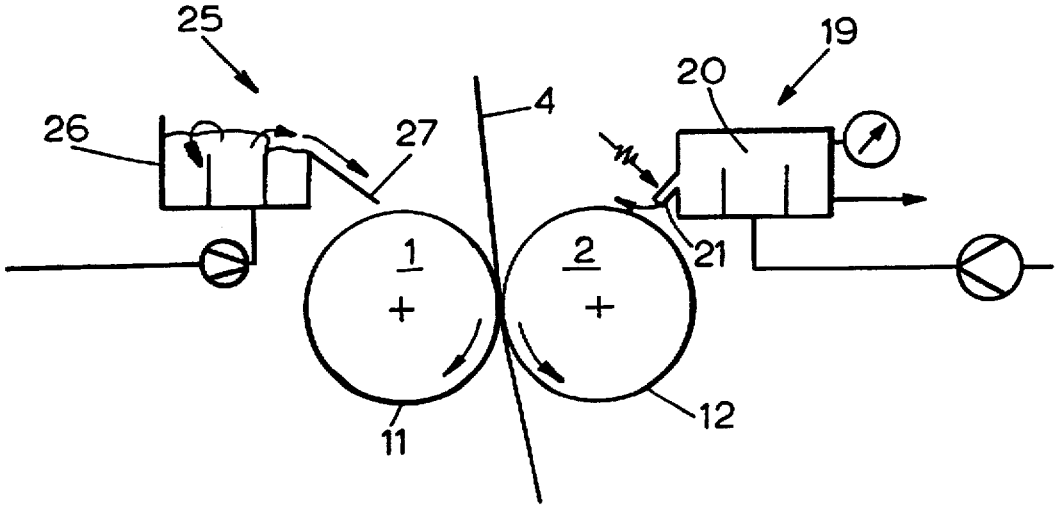
FIG. 4 is a schematic sectional view of a fourth embodiment of a device according to the invention.

FIG. 4 illustrates a two-roll applicator device with a closed head box cooperating with one applicator roll and an open head box cooperating with the other applicator roll. In particular, FIG. 4 shows the possibility of pre-metering a coating composition directly onto an applicator roll of a two-roll applicator device using a closed head box 19. The basic structure of the two-roll applicator device corresponds to that shown in FIGS. 1 to 3 and therefore the same elements have been assigned the same reference numbers. Introduction of a coating composition onto the roll 2 is performed directly onto the surface 12 of the applicator roll 2.

The head box 19 includes a pressurizable container 20 with a discharge line 21 extending essentially over the entire width of the machine. The flow-through cross-section of the discharge line 21 has a variable cross-section, but is constant over the width of the application. A pressurized emission of coating material thus flows from the discharge 21 in a manner similar to the "free jet" discussed herein with respect to embodiments according to the invention utilizing free-jet nozzle devices 5. In order to provide a forced stream or spray which is "free" (i.e., unimpeded; not constrained or otherwise obstructed), the discharge line 21 is preferably at least about 4 mm from the surface 12 of the applicator roll 2.

The application of a medium onto the applicator roll 1 is performed with the aid of an open head box 25, which has, for example, a central open container 26 with a separating weir and a discharge element 27 through which coating composition flows onto the surface 11 of the applicator roll 1.

In order to adjust metering action, additional means are necessary at the head box (not shown). They are, for example, a diaphragm assigned to the discharge element 27, which acts as a damper.

Figure 5:
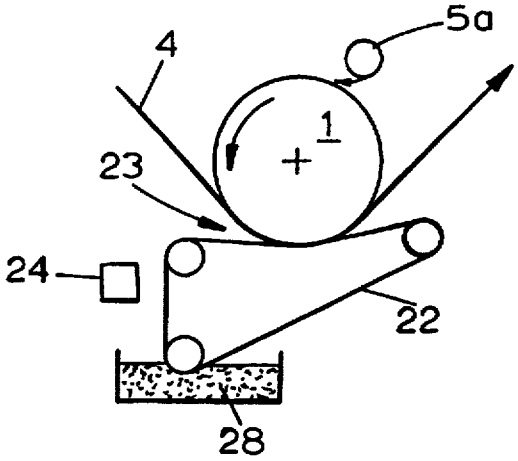
FIG. 5 is a schematic sectional view of a fifth embodiment of a device according to the invention.

FIG. 5 shows a two-element applicator device consisting of a roll and belt cooperating with a free-jet nozzle device. FIG. 5 shows a two-element applicator device which includes an applicator roll 1, which forms an extended press gap 23 with a revolving belt or wire 22. A free-jet nozzle device 5*a* is assigned to cooperate with the applicator roll 1 and is disposed in the vicinity thereof. The rotating endless belt 22 is coated by passing the belt through a container 28 filled with a medium, for example, a sizing suspension, and the amount of sizing that is carried away by the belt 22 is equalized with a blade 24, which is disposed downstream of the container 28 with respect to a direction of movement of the belt 22.

The embodiment of the device according to the invention shown in FIG. 5 is preferably suitable for two-sided coating with different application media, while the embodiments shown in FIGS. 1 to 4 are preferably suitable for two-sided coating with the same application medium. However, here, too, one can consider different and/or only one-sided coating. The embodiments shown in FIGS. 1 and 4 provide the possibility to assign the same applicator units to the two applicator elements. The embodiments of the invention discussed herein are particularly suitable for the application of a color coating medium onto a paper web.

The foregoing detailed description is given for clearness of understanding only, and no unnecessary limitations should be understood therefrom, as modifications within the scope of the invention will be apparent to those skilled in the art.

We claim:

1. In a method of at least one-sided coating of a material web with an application medium in an applicator device having at least one applicator roll and a counter element driven in opposite directions and defining a gap through which the material web is conveyed, said method comprising the steps of pre-metering the application medium onto the applicator roll and transferring the application medium onto the material web in the gap, the improvement comprising the steps of:

providing an apparatus having a nozzle for the emission of the application medium onto an application surface without the nozzle coming in contact with said application surface;

optionally providing a transfer roll forming a press gap with the applicator roll; and pre-metering the application medium to the applicator device by emitting the application medium from the nozzle for a distance of at least about 4 mm and impinging the application medium directly onto the application surface, said surface being one of a surface of the applicator roll and a surface of the transfer roll.

2. The improvement of claim 1 wherein the apparatus is at least one of displaceable in a radial direction with respect to the surface upon which the application medium is directed and rotatable about an axis thereof providing for variable adjustment of an angle between a direction of emission of the application medium and the surface upon which the application medium is directed.

3. A device for performing at least one-sided coating of a material web with an application medium, said device comprising:

first and second applicator elements driven in opposite directions and defining a gap for the passage of a material web therebetween, at least one of said applicator elements being a roll;

optionally, a transfer roll forming a press gap with one of the applicator elements; and an applicator unit assigned to at least one of said first applicator element, said second applicator element, and said optional transfer roll, said applicator unit having an apparatus with a nozzle for the emission of an application medium directly onto a surface of one of the first applicator element, the second applicator element and the transfer roll without the nozzle coming in contact with said surface, said apparatus being variably displaceable in a radial direction in relation to said surface and rotatable about an axis thereof providing for variable adjustment of an application angle defined by a direction of emission of the application medium and said surface, wherein an outlet opening of the nozzle is disposed at least about 4 mm from the surface upon which the application medium is applied.

4. The device of claims 3 wherein the apparatus applies the application medium directly onto one of the applicator elements.

5. The device of claim 3 wherein said apparatus applies the application medium directly onto the transfer roll.

6. The device of claim 3 wherein the apparatus is disposed at a location directly upstream of at least one of an inlet of the gap formed by said applicator elements and an inlet of a gap formed by one of said applicator elements and said transfer roll, the upstream location being defined with respect to a direction of rotation of one of said applicator elements.

7. The device of claim 3 wherein the apparatus is a closed head box having a container under pressure.

8. The device of claim 3 wherein the apparatus has outlet openings having cross-sections that are variably adjustable.

9. The device of claim 3 further comprising equalizing devices for providing a uniform film of the application medium on the surface of at least one of the applicator elements and the transfer roll, said equalizing devices disposed downstream of the apparatus with respect to a direction of rotation of at least one of said applicator elements.

10. The device of claim 9 wherein the equalizing devices are air brushes.

11. A device for performing at least one-sided coating of a material web with an application medium, said device comprising:

first and second applicator elements driven in opposite directions and defining a gap for the passage of a material web therebetween, at least one of said applicator elements being a roll;

an applicator unit assigned to a least one of said first and second applicator elements, said applicator unit designed as an open head box for applying an application medium onto a surface of the assigned applicator element; and means for pre-metering a pressurized flow of application medium disposed at the head box and directing the medium directly on the surface of the assigned applicator element, an outlet opening of the pre-metering means being disposed at least about 4 mm from the surface of the assigned applicator element.

* * * * *